US008781371B2

(12) United States Patent
Watanabe et al.

(10) Patent No.: US 8,781,371 B2
(45) Date of Patent: Jul. 15, 2014

(54) STIR-TRANSPORT MEMBER, DEVELOPMENT DEVICE PROVIDED THEREWITH, AND IMAGE FORMING APPARATUS

(75) Inventors: Akihiro Watanabe, Osaka (JP); Norio Kubo, Osaka (JP); Yukihiro Mori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 222 days.

(21) Appl. No.: 13/367,743

(22) Filed: Feb. 7, 2012

(65) Prior Publication Data

US 2012/0201573 A1 Aug. 9, 2012

(30) Foreign Application Priority Data

Feb. 7, 2011 (JP) ..... 2011-23477

(51) Int. Cl.
*G03G 15/08* (2006.01)

(52) U.S. Cl.
USPC ..... 399/256; 366/321; 366/322; 366/323

(58) Field of Classification Search
CPC ..... G03G 2215/0816; G03G 2215/0819; G03G 2215/0827; G03G 2215/083; G03G 2215/0833
USPC ..... 399/254, 256; 366/319, 321–323
See application file for complete search history.

(56) References Cited

U.S. PATENT DOCUMENTS

| | | | | |
|---|---|---|---|---|
| 2004/0057755 | A1 * | 3/2004 | Yamaguchi et al. | 399/256 |
| 2006/0159492 | A1 * | 7/2006 | Yokoyama | 399/256 |
| 2006/0182467 | A1 * | 8/2006 | Aoki et al. | 399/254 |
| 2007/0081832 | A1 * | 4/2007 | Yoshida et al. | 399/254 |
| 2008/0025763 | A1 | 1/2008 | Suenami | |
| 2011/0069993 | A1 * | 3/2011 | Yamamuro et al. | 399/254 |

FOREIGN PATENT DOCUMENTS

| | | |
|---|---|---|
| JP | 2002-006597 A | 1/2002 |
| JP | 2008-033109 A | 2/2008 |

* cited by examiner

*Primary Examiner* — Walter L Lindsay, Jr.
*Assistant Examiner* — Milton Gonzalez
(74) *Attorney, Agent, or Firm* — NDQ&M Watchstone LLP

(57) ABSTRACT

A stir-transport member is formed on a circumferential surface of a rotation shaft with a first spiral blade, and a second spiral blade formed to overlap the region of the first spiral blade and is opposite the first spiral blade in phase and having a smaller radial-direction height than the first spiral blade. Sections of the spiral blades along the cross longitudinal direction thereof have trapezoidal shapes. The first spiral blade have a plurality of first swell portions, a part of each corresponding to a bottom of the trapezoidal shape and is more swollen than the other portions. The second spiral blade have a plurality of second swell portions, a part of each corresponding to the bottom of the trapezoidal shape and is more swollen than the other portions. The first spiral blade cross the second spiral blade at least at one of the first swell portions per turn.

5 Claims, 5 Drawing Sheets

STIR-TRANSPORT MEMBER, DEVELOPMENT DEVICE PROVIDED THEREWITH, AND IMAGE FORMING APPARATUS

INCORPORATION BY REFERENCE

This application is based on JP-A-2011-23477 (filed on Feb. 7, 2011), the contents of which are hereby incorporated by reference.

BACKGROUND

The present disclosure is related to a stir-transport member which stirs and transports powder such as a developer, a development device provided therewith, and an image forming apparatus incorporating the development device.

In an image forming apparatus, a latent image formed on an image bearing member which includes a photosensitive body and the like is developed by a development device to thereby visualize the latent image as a toner image. An example of such a development device adopts a two-component developing method in which a two-component developer is used. This type of development device stores, in a development container, a developer including a carrier and toner. The development device includes a development roller which supplies the developer to an image bearing member, and a stir-transport member which supplies the developer in the development container to the development roller by stirring and transporting the developer.

With the two-component developing method, insufficiently charged toner may result in an defective image suffering from scattered toner, a fog phenomenon, or the like. To prevent this, it is necessary to fully stir the toner and the carrier, to thereby charge the toner to a predetermined level.

To achieve this, for example, there has been known a powder stir-transport member that includes: a shaft member; a main transport blade which transports powder in a first direction toward one end side along the axis of the shaft member as the shaft member rotates; and sub transport means which generates a transport movement of transporting part of the powder in a second direction toward the other end side along the axis of the shaft member as the shaft member rotates. As the sub transport means, there has been known an oppositely-wound (opposite-phased) sub transport blade which is smaller than the main transport blade in diameter.

With this arrangement, by the sub transport means generating the transport movement in the direction opposite to the direction in which the powder is transported by the main transport blade, convection is caused to occur with respect to part of the powder while it is transported, and this makes it possible to promote the stirring of the powder without obstructing the transporting operation performed by the main transport blade.

On the other hand, there has been known a resin toner-stir-and-transport screw that has a spiral blade whose section taken along a direction that crosses the longitudinal direction thereof has a trapezoidal shape, and in which, in a turn thereof around a shaft, there are formed a plurality of portions in each of which a part corresponding to the bottom of the trapezoidal shape is more swollen than in the other portions.

With this arrangement, provision of the portions in each of which a part corresponding to the bottom of the trapezoidal shape is more swollen than in the other portions helps enhance the effect of strengthening the spiral blade, and thus to achieve improved performance of stirring and transporting toner. In addition, the volume of the spiral blade can be made smaller than with a design in which parts corresponding to the bottom of the trapezoidal shape are formed wider all along the spiral blade, and this makes it possible to widen the space in each pitch (where toner can be held) of the spiral blade. Furthermore, by swelling portions corresponding to joints between separate molds, the toner-stir-and-transport screw can be easily pulled out from the mold.

In the above-described stir-transport member provided with the main transport blade and the sub transport blade, if, as described above, portions in each of which a part corresponding to the bottom of the trapezoidal shape is more swollen than in the other portions are formed in a turn of a spiral blade around the shaft, it is necessary to form such portions not only in the main transport blade but also in the sub transport blade.

This results in an arrangement where each spiral blade includes portions in each of which a part corresponding to the bottom of the trapezoidal shape is swollen. Such swell portions are inferior in transporting performance to the other portions, and moreover, are liable to change the flow of the developer and ruffle the developer. Thus, it is not desirable to form many swell portions. Also, in addition to the portions in each of which a part corresponding to the bottom of the trapezoidal shape is swollen, portions at which the main transport blade and the sub transport blade cross each other also tend to change the flow of the developer and ruffle the developer.

Thus, at the swell portions of the main and sub transport blades and at the portions where the main transport blade and the sub transport blade cross each other, the developer flows in an unstable manner. As a result, the developer receives an increased amount of stress while it is stirred and transported between the stir-transport member and the housing of the development device, and this disadvantageously promotes degradation of the carrier. This degradation of the carrier is liable to be affected by change of flowability of the developer which is caused by an environmental change, and the degradation becomes remarkable when the flowability of the developer is reduced.

SUMMARY

In view of the above problems, an object of the present disclosure is to provide a stir-transport member that does not apply excessive stress to powder such as developer while satisfactorily stirring and transporting the powder, and that is also excellent in moldability, a development device provided therewith, and an image forming apparatus.

According to one aspect of the present disclosure, a stir-transport member includes a rotation shaft which is rotatably supported in a powder container, a first spiral blade which is formed on an outer circumferential surface of the rotation shaft to transport powder in an axial direction when the rotation shaft rotates, and a second spiral blade which is formed on the outer circumferential surface of the rotation shaft so as to overlap a region where the first spiral blade is formed, the second spiral blade being opposite to the first spiral blade in phase, the second spiral blade being formed to have a smaller radial-direction height than the first spiral blade. Here, sections of the first spiral blade and the second spiral blade taken along directions that cross longitudinal directions thereof have trapezoidal shapes, the first spiral blade has a plurality of first swell portions, in each of which a part corresponding to a bottom of the trapezoidal shape is more swollen than in other portions of the first spiral blade, formed in a turn of the first spiral blade around the rotation shaft, the second spiral blade has a plurality of second swell portions, in each of which a part corresponding to the bottom of the trapezoidal shape is more swollen than in other portions of the second spiral blade, formed in a turn of the second spiral blade around the rotation shaft, and the first spiral blade crosses the second spiral blade at least at one of the first swell portions in a turn thereof around the rotation shaft.

Other objects and specific advantages of the present disclosure will become more apparent from the description of embodiments set forth below.

DETAILED DESCRIPTION

Figure 1:
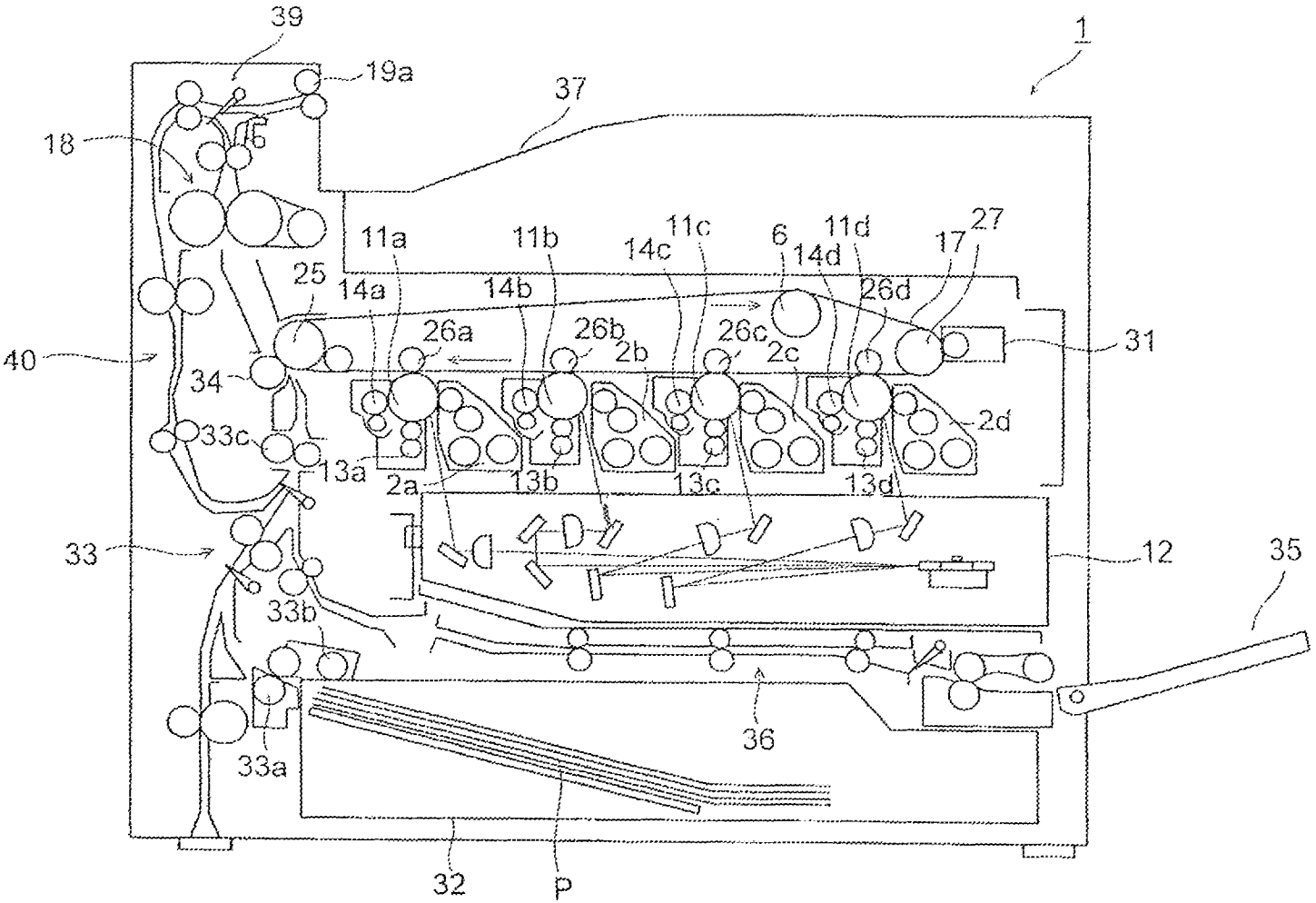
FIG. 1 is a diagram schematically showing the overall structure of an image forming apparatus 1 incorporating development devices 2*a* to 2*d* embodying the present disclosure.

Hereinafter, with reference to the accompanying drawings, descriptions will be given of embodiments of the present disclosure. FIG. 1 is a sectional view schematically showing the structure of an image forming apparatus 1 incorporating development devices 2*a* to 2*d* of the present disclosure. The image forming apparatus 1 is a tandem-type color printer which includes rotatable photosensitive drums 11*a* to 11*d* which are built with, for example, organic photosensitive bodies (OPC photosensitive bodies) on each of which an organic photosensitive layer is formed or with amorphous silicon photosensitive bodies on each of which an amorphous silicon photosensitive layer is formed. The photosensitive drums 11*a* to 11*d* are provided corresponding to colors of magenta, cyan, yellow, and black. Around the photosensitive drums 11*a* to 11*d*, there are disposed development devices 2*a* to 2*d*, an exposure unit 12, chargers 13*a* to 13*d*, and cleaners 14*a* to 14*d*.

The development devices 2*a* to 2*d* are disposed to the right of, and facing, the photosensitive drums 11*a* to 11*d*, respectively, and supply toner to the photosensitive drums 11*a* to 11*d*, respectively. The chargers 13*a* to 13*d* are disposed upstream of the development devices 2*a* to 2*d*, respectively, in the direction in which the photosensitive drums rotate, the chargers 13*a* to 13*d* facing the surfaces of the photosensitive drums 11*a* to 11*d*, respectively, so as to uniformly charge the surfaces of the photosensitive drums 11*a* to 11*d*, respectively.

The exposure unit 12 is provided for scanningly exposing the photosensitive drums 11*a* to 11*d* based on image data representing letters or patterns that is fed to an image input portion (unillustrated) from a personal computer or the like; the exposure unit 12 is disposed below the development devices 2*a* to 2*d*. The exposure unit 12 is provided with a laser light source and polygon mirrors, and is also provided with reflection mirrors and lenses corresponding to the photosensitive drums 11*a* to 11*d*. Laser light emitted from the laser light source is applied to the surfaces of the photosensitive drums 11*a* to 11*d* from the downstream side of the chargers 13*a* to 13*d*, respectively, in the direction in which the photosensitive drums rotate, via the polygon mirrors, the reflection mirrors, and the lenses. The laser light applied to the photosensitive drums 11*a* to 11*d* forms electrostatic latent images on the surfaces of the photosensitive drums 11*a* to 11*d* according to the image data. Then, the electrostatic latent images are developed into toner images by the development devices 2*a* to 2*d*.

An intermediate transfer belt 17, which is an endless belt, is wound around a tension roller 6, a drive roller 25, and a driven roller 27. The drive roller 25 is driven to rotate by an unillustrated motor, and the intermediate transfer belt 17 is driven to circulate by the rotation of the drive roller 25.

The photosensitive drums 11*a* to 11*d* are arranged under the intermediate transfer belt 17, side by side along a transport direction (a direction indicated by an arrow in FIG. 1), such that they are in contact with the intermediate transfer belt 17. Primary transfer rollers 26*a* to 26*d* face the photosensitive drums 11*a* to 11*d*, respectively, with the intermediate transfer belt 17 in between, and the primary transfer rollers 26*a* to 26*d* are in press-contact with the intermediate transfer belt 17 to form a primary transfer portion. In the primary transfer portion, along with the rotation of the intermediate transfer belt 17, at a predetermined timing, the toner images on the photosensitive drums 11*a* to 11*d* are transferred onto the intermediate transfer belt 17 in series. Thus, the toner images of magenta, cyan, yellow, and black colors are superimposed on one another on a surface of the intermediate transfer belt 17, and thereby a full-color toner image is formed.

A secondary transfer roller 34 faces the drive roller 25 with the intermediate transfer belt 17 in between, and is in press-contact with the intermediate transfer belt 17 to form a secondary transfer portion. In the secondary transfer portion, the toner image on the intermediate transfer belt 17 is transferred onto a paper sheet P. After the transfer, a belt cleaner 31 removes residual toner from the intermediate transfer belt 17.

At a lower portion of the image forming apparatus 1, there is disposed a paper cassette 32 for storing paper sheets P therein, and to the right of the paper cassette 32, there is disposed a stack tray 35 via which paper is fed manually. To the left of the paper cassette 32, there is disposed a first paper transport path 33 through which a paper sheet P fed from the paper cassette 32 is transported to the secondary transfer portion of the intermediate transfer belt 17. To the left of the stack tray 35, there is disposed a second paper transport path 36 through which paper fed from the stack tray 35 is transported to the secondary transfer portion. Furthermore, to the above-left of the image forming apparatus 1, there are disposed a fixing portion 18 which performs fixing processing on the paper sheet P on which an image is formed and a third paper transport path 39 through which the paper sheet P that has undergone the fixing processing is transported to a paper ejection portion 37.

The paper cassette 32 is structured to be pulled out from the image forming apparatus 1 (frontward in FIG. 1) to be refilled with sheets of paper. Paper sheets P stacked in the paper cassette 32 is sent one by one to the first paper transport path 33 side by a pickup roller 33*b* and a separation roller 33*a*.

The first paper transport path 33 and the second paper transport path 36 join together at a position before (upstream-side of) the resist roller 33*c* with respect to the paper transport direction. Timings of the image forming operation at the intermediate transfer belt 17 and paper feeding operation are adjusted by the resist roller 33*c*, and the paper sheet P is transported to the secondary transfer portion. A secondary transfer of the full-color toner image formed on the intermediate transfer belt 17 is performed onto the paper sheet P, which has been transported to the secondary transfer portion, by the secondary transfer roller 34 to which a bias potential is applied, and then the paper sheet P is transported to the fixing portion 18.

The fixing portion 18 includes components such as a fixing belt which is heated by a heater, a fixing roller which is in internal contact with the fixing belt, and a pressure roller which is disposed to be in press-contact with the fixing roller with the fixing belt in between, and the fixing portion 18 performs the fixing processing by applying heat and pressure to the paper sheet P onto which the toner image has been transferred. After the toner image is fixed on the paper sheet P at the fixing portion 18, the paper sheet P is turned upside down at a fourth paper transport path 40, as necessary, and secondary transfer of a toner image is performed on the back side of the paper sheet P as well. The secondary-transferred toner image is fixed at the fixing portion 18. The paper sheet P on which the toner image is fixed passes through the third paper transport path 39, and is ejected by an ejection roller 19*a* to the paper ejection portion 37.

Figure 2:
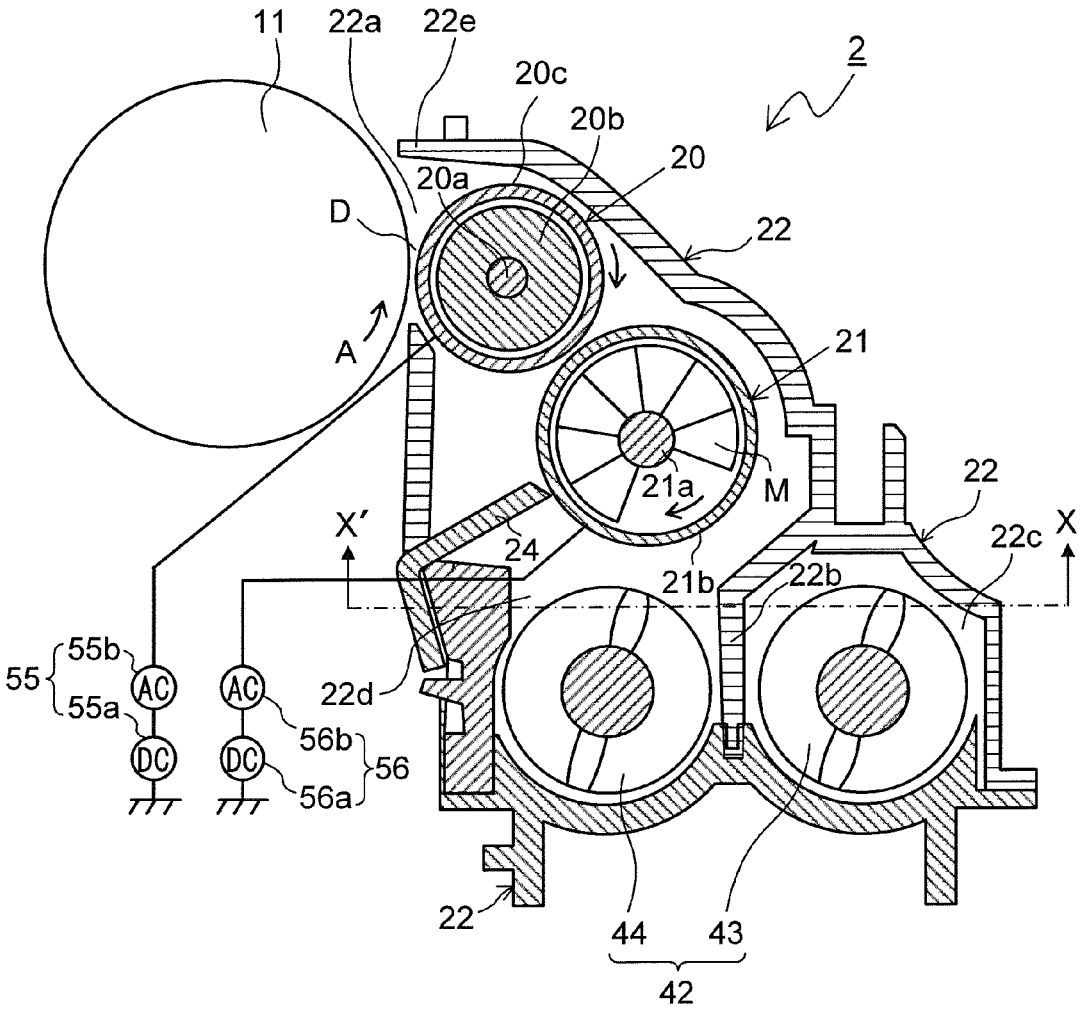
FIG. 2 is a side sectional view showing a development device 2 incorporating a stir-transport member embodying the present disclosure.

FIG. 2 is a side sectional view showing the structure of the development devices 2*a* to 2*d* embodying the present disclosure. The following description will describe a structure and operation of the development device 2*a* which corresponds to the photosensitive drum 11*a*, and will not describe structures or operations of the development devices 2*b* to 2*d*, each of which has the same structure, and operates in the same manner, as the development device 2*a*. In the following description, the development device and the photosensitive drum will be denoted without reference signs a to d used for indicating difference in color between the developing apparatuses and photosensitive drums.

As shown in FIG. 2, the development device 2 is formed with a development roller 20, a magnetic roller 21, a regulation blade 24, a stir-transport member 42, a development container 22, etc.

The development container 22 forms an outer frame of the development device 2, and a lower portion of the development container 22 is partitioned by a partition portion 22*b* into a first transport chamber 22*c* and a second transport chamber 22*d*. A developer including toner and a carrier is put in the first transport chamber 22*c* and the second transport chamber 22*d*. The development container 22 rotatably holds the stir-transport member 42, the magnetic roller 21, and the development roller 20. Furthermore, in the development container 22, there is formed an opening 22*a* through which the development roller 20 is exposed toward the photosensitive drum 11.

The development roller 20 is disposed to the right of the photosensitive drum 11 to face the photosensitive drum 11 over a constant distance. The development roller 20, at a position that is close to and opposite to the photosensitive drum 11, forms a developing region D where toner is supplied to the photosensitive drum 11. The magnetic roller 21 faces the development roller 20 over a constant distance, and is disposed to the lower right of the development roller 20. The magnetic roller 21, at a position that is close to and opposite to the development roller 20, supplies toner to the development roller 20. The stir-transport member 42 is disposed substantially under the magnetic roller 21. The regulation blade 24 is disposed to the lower left of the magnetic roller 21 and is fixedly held by the development container 22.

The stir-transport member 42 is composed of two spirals, namely, a first spiral 43 and a second spiral 44. The second spiral 44 is disposed in the second transport chamber 22*d*, under the magnetic roller 21, and the first spiral 43 is disposed in the first transport chamber 22*c*, to be next to, and to the right of, the second spiral 44.

The first and second spirals 43 and 44 stir the developer to charge the toner in the developer to a predetermined level. In this way, the toner is held by the carrier. Communication portions (not shown) are formed at two ends of the partition portion 22*b* which partitions the first transport chamber 22*c* from the second transport chamber 22*d* in a longitudinal direction (a direction perpendicular to the sheet on which FIG. 2 is drawn). When the first spiral 43 rotates, the electrically-charged developer is transported through one of the communication portions formed in the partition portion 22*b* to the second spiral 44, and the developer circulates in the first transport chamber 22*c* and the second transport chamber 22*d*. Then, the developer is supplied from the second spiral 44 to the magnetic roller 21.

The magnetic roller 21 includes a roller shaft 21*a*, a magnetic pole member M, and a nonmagnetic sleeve 21*b* made of a nonmagnetic material; the magnetic roller 21 holds the developer supplied from the stir-transport member 42, and supplies to the development roller 20 only the toner from the developer that it holds. The magnetic pole member M is formed by alternately arranging a plurality of sectionally fan-shaped magnets having different polarities at circumferential portions thereof, and the magnetic pole member M is fixed to the roller shaft 21*a* by, for example, adhesion. The roller shaft 21*a* is, inside the nonmagnetic sleeve 21*b*, unrotatably supported by the development container 22 such that a predetermined space is provided between the magnetic pole member M and the nonmagnetic sleeve 21*b*. The nonmagnetic sleeve 21*b* is driven by an unillustrated drive mechanism including a motor and a gear to rotate in the same direction as the development roller 20 (the clockwise direction in FIG. 2), and a bias 56 resulting from superposing an AC voltage 56*b* on a DC voltage 56*a* is applied to the nonmagnetic sleeve 21*b*. On a surface of the nonmagnetic sleeve 21*b*, the electrically-charged developer is carried by the magnetic force of the magnetic pole member M in a form of a magnetic brush, whose height is adjusted to a predetermined height by the regulation blade 24.

When the nonmagnetic sleeve 21*b* rotates, the magnetic brush is carried on the surface of the nonmagnetic sleeve 21*b* by the magnetic pole member M and transported. Then, when the magnetic brush comes into contact with the development roller 20, only the toner of the magnetic brush is supplied to the development roller 20 according to the bias 56 applied to the nonmagnetic sleeve 21*b*.

The development roller 20 includes a stationary shaft 20*a*, a magnetic pole member 20*b*, a development sleeve 20*c* which is formed of a nonmagnetic metal material in a cylindrical shape, etc.

The stationary shaft 20*a* is unrotatably supported in the development container 22. At the stationary shaft 20*a*, the development sleeve 20*c* is rotatably held, and further, the magnetic pole member 20*b*, which is formed with a magnet, is fixed to the stationary shaft 20*a* by adhesion or the like such that the magnetic pole member 20*b* is located to face the magnetic roller 21 with a predetermined space provided between the development sleeve 20*c* and the magnetic pole member 20*b*. The development sleeve 20*c* is driven by an unillustrated drive mechanism including a motor and a gear, to rotate in a direction (clockwise direction) indicated by an arrow in FIG. 2. Also, to the development sleeve 20*c*, there is applied a development bias 55 resulting from superposing an AC voltage 55*b* on a DC voltage 55*a*.

When the development sleeve 20*c* to which the development bias 55 is applied rotates in the clockwise direction in FIG. 2, then, in the developing region D, due to a difference between a potential of the development bias and potentials of exposed portions of the photosensitive drum 11, the toner carried on the surface of the development sleeve 20*c* flies to the photosensitive drum 11. The flying toner sequentially adheres to the exposed portions on the photosensitive drum 11 rotating in the direction indicated by arrow A (a counter-clockwise direction), and thereby, the electrostatic latent image on the photosensitive drum 11 is developed.

Figure 3:
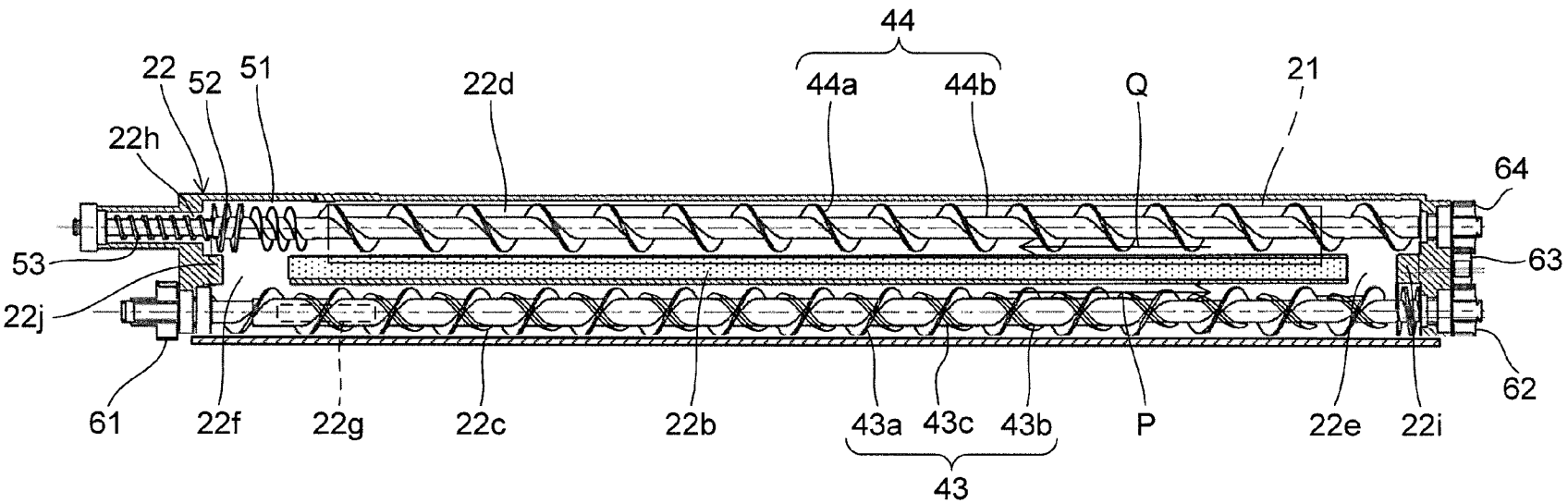
FIG. 3 is a plan sectional view showing a stir portion of the development device 2 embodying the present disclosure.

Next, with reference to FIG. 3, a detailed description will be given of a stir portion of the development device. FIG. 3 is a plan sectional view (sectional view taken along line X-X' in FIG. 2) showing the stir portion of the development device 2 embodying the present disclosure.

In the development container 22, as already described above, the first transport chamber 22*c*, the second transport chamber 22*d*, the partition portion 22*b*, the upstream-side communication portion 22*e*, and the downstream-side communication portion 22*f* are formed, and in addition, a developer supply port 22*g*, a developer discharge port 22*h*, an upstream-side wall portion 22*i*, and a downstream-side wall portion 22*j* are formed. In the first transport chamber 22*c*, the left side in FIG. 3 is assumed to be the upstream side, and the right side in FIG. 3 is assumed to be the downstream side. In the second transport chamber 22*d*, the right side in FIG. 3 is assumed to be the upstream side, and the left side in FIG. 3 is assumed to be the downstream side. In this way, the communication portions and the wall portions are denoted with "upstream-side" or "downstream-side" according to which side of the second transport chamber 22*d* they are located.

The partition portion 22*b* extends in a longitudinal direction of the development container 22 to partition the first transport chamber 22*c* and the second transport chamber 22*d* from each other such that they are arranged in parallel with each other. A right-side end portion of the partition portion 22*b* in the longitudinal direction and an inner wall portion of the upstream-side wall portion 22*i* together form the upstream-side communication portion 22*e*. On the other hand, a left-side end portion of the partition portion 22*b* in the longitudinal direction and an inner wall portion of the downstream-side wall portion 22*j* together form the downstream-side communication portion 22*f*. The developer is able to circulate in the first transport chamber 22*c*, the upstream-side communication portion 22*e*, the second transport chamber 22*d*, and the downstream-side communication portion 22*f*.

The developer supply port 22*g* is an opening for supplying, into the development container 22, the toner and the carrier from a developer supply container (not shown) formed in an upper portion of the development container 22, and the developer supply port 22*g* is disposed on the upstream side (the right side in FIG. 3) of the first transport chamber 22*c*.

The developer discharge port 22*h* is an opening formed for discharging therethrough a surplus portion of the developer in the first and second transport chambers 22*c* and 22*d* after the developer is added, and the developer discharge port 22*h* is located on the downstream side of the second transport chamber 22*d* to be continuous with the second transport chamber 22*d* in the longitudinal direction.

Within the first transport chamber 22*c*, the first spiral 43 is disposed, and within the second transport chamber 22*d*, the second spiral 44 is disposed.

The first spiral 43 has a rotation shaft 43*b*, a first spiral blade 43*a* which is formed to be integral with the rotation shaft 43*b* in a spiral form winding around the rotation shaft 43*b* at a uniform pitch along the axial direction of the rotation shaft 43*b*, and a second spiral blade 43*c* which is formed to be integral with the rotation shaft 43*b* in a spiral form around the rotation shaft 43*b* at the same pitch as the first spiral blade 43*a* along the axial direction of the rotation shaft 43*b* but winding in a direction (opposite phase) opposite to the winding direction of the first spiral blade 43*a*. The first spiral blade 43*a* and the second spiral blade 43*c* extend to both end portions of the first transport chamber 22*c* in the longitudinal direction, so that they are also disposed facing the upstream-side and downstream-side communication portions 22*e* and 22*f*. The rotation shaft 43*b* is rotatably supported by the upstream-side wall portion 22*i* and the downstream-side wall portion 22*j* of the development container 22. A description will be given later of the details of the structures of the first spiral blade 43*a* and the second spiral blade 43*c*.

The second spiral 44 has a rotation shaft 44*b* and a spiral blade 44*a* which is formed to be integral with the rotation shaft 44*b* in a spiral form winding around the rotation shaft 44*b* at the same pitch as the first spiral blade 43*a* of the first spiral 43 along the axial direction of the rotation shaft 44*b* but winding in a direction (opposite phase) that is opposite to the winding direction of the first spiral blade 43*a*. The spiral blade 44*a* has a length equal to or longer than that of the magnetic roller 21 in the axial direction, and extends as far as to a position that faces the upstream-side communication portion 22*e*. The rotation shaft 44*b* is disposed in parallel with the rotation shaft 43*b*, and rotatably supported by the upstream-side wall portion 22*i* and the downstream-side wall portion 22*j* of the development container 22. In addition, a restriction portion 52 and a discharge blade 53 as well as the spiral blade 44*a* are disposed to be integral with the rotation shaft 44*b*.

The restriction portion 52 is provided to block the developer that is transported to the downstream side in the second transport chamber 22*d*, and also to transport a surplus portion of the developer to the developer discharge port 22*h* when the amount of developer exceeds a predetermined amount. The restriction portion 52 is formed as a spiral blade winding around the rotation shaft 44*b* in a direction (opposite phase) opposite to the winding direction of spiral blade 44*a*; the restriction portion 52 is formed to have substantially the same external diameter as the spiral blade 44*a*, at a pitch that is smaller than the pitch of the spiral blade 44*a*. The restriction portion 52 is disposed such that a gap of a predetermined size is provided between an outer circumference portion of the restriction portion 52 and an inner wall portion of the development container 22 including the downstream-side wall portion 22*j*. It is through this gap that the surplus portion of the developer is discharged.

The rotation shaft 44*b* extends as far as to an inside of the developer discharge port 22*h*. At the rotation shaft 44*b* in the developer discharge port 22*h*, the discharge blade 53 is provided. The discharge blade 53 is formed as a spiral blade winding in the same direction as the winding direction of the spiral blade 44*a* at a pitch that is smaller than the pitch of the spiral blade 44*a*, and has a smaller external diameter than the spiral blade 44*a*. As a result, when the rotation shaft 44*b* rotates, the discharge blade 53 also rotates with it, and the surplus portion of the developer that is transported over the restriction portion 52 into the developer discharge port 22*h* is transported to the left side in FIG. 3, and is then discharged to the outside of the development container 22. The discharge blade 53, the regulation shaft 52, and the spiral blade 44*a* are formed of a synthetic resin to be integral with the rotation shaft 44*b*.

Gears 61 to 64 are disposed on an outer wall of the development container 22. The gears 61 and 62 are fixed to the rotation shaft 43*a*, the gear 64 is fixed to the rotation shaft 44*b*, and the gear 63 is rotatably held by the development container 22 and meshes with the gears 62 and 64.

In a case of development performed without new supply of developer, when the gear 61 is driven to rotate by a drive source such as a motor, the first spiral blade 43*a* rotates along with the rotation shaft 43*b*. By the rotation of the first spiral blade 43*a*, the developer is transported in the direction indicated by arrow P in the first transport chamber 22*c*, and thereafter, the developer is transported via the upstream-side communication portion 22*e* into the second transport chamber 22*d*. Furthermore, when the spiral blade 44*a* rotates along with the rotation shaft 44*b* which rotates with the rotation shaft 43*b*, the developer is transported by the spiral blade 44*a* in the direction indicated by arrow Q inside the second transport chamber 22*d*. Thus, the developer is transported from the first transport chamber 22*c*, via the upstream-side communication portion 22*e*, into the second transport chamber 22*d*, drastically changing its heap height, and is transported, without moving over the regulation shaft 52, through the downstream-side communication portion 22*f* into the first transport chamber 22*c*.

In this way, the developer is stirred while circulating from the first transport chamber 22*c*, to the upstream-side communication portion 22*e*, the second transport chamber 22*d*, and the downstream-side communication portion 22*f*; the thus stirred developer is supplied to the magnetic roller 21.

Next, a description will be given of a case where the developer is added from the developer supply port 22*g*. When the toner is consumed in development, the developer including the toner and the carrier is added from the developer supply port 22*g* into the first transport chamber 22*c*.

The added developer is, in the same manner as in development, transported by the first spiral blade 43*a* in the direction indicated by arrow P inside the first transport chamber 22*c*, and thereafter, the added developer is transported through the upstream-side communication portion 22*e* into the second transport chamber 22*d*. Furthermore, the developer is transported by the spiral blade 44*a* in the direction indicated by arrow Q inside the second transport chamber 22*d*. When the regulation shaft 52 rotates along with the rotation of the rotation shaft 44*b*, the restriction portion 52 gives the developer a transporting force in a direction opposite to the direction in which the developer is transported by the spiral blade 44*a*. The developer is stopped by the restriction portion 52 to form a high heap, and an surplus portion of the developer flows over the restriction portion 52 to be discharged via the developer discharge port 22*h* to the outside of the development container 22.

With the first spiral 43 structured as described above, the first spiral blade 43*a* is formed on an outer surface of the rotation shaft 43*b*, and the first spiral blade 43*a*, along with the rotation of the rotation shaft 43*b*, stirs the developer while transporting the developer in a first direction (arrow-P direction in FIG. 3). Furthermore, on the outer surface of the rotation shaft 43*b*, the second spiral blade 43*c*, whose phase is opposite to that of the first spiral blade 43*a* and whose diameter is smaller than that of the first spiral blade 43*a*, is formed in pitch spaces (spaces between adjacent pitches) of the first spiral blade 43*a*. The second spiral blade 43*c*, which rotates along with the rotation of the rotation shaft 43*b*, generates a transport movement of transporting the developer in a second direction (arrow Q direction in FIG. 3) which is opposite to the first direction.

The second spiral blade 43*c* is located inward from an external end portion of the first spiral blade 43*a* in the diameter direction, and thus the transport movement in the second direction generated by the rotation of the second spiral blade 43*c* only works on part of the developer that exists in the vicinity of the rotation shaft 43*b*. Thus, the transport movement in the second direction does not interfere with the transport movement in the first direction generated by the first spiral blade 43*a*.

In this way, by using the second spiral blade 43*c* to generate the transport movement in the direction (second direction) opposite to the direction (first direction) in which the developer is transported by the first spiral blade 43*a*, convection of the developer is generated in the pitch spaces of the first spiral blade 43*a*, and thereby, the stirring of the developer in the pitch spaces of the first spiral blade 43*a* is promoted without interfering with the powder (developer) transport by the first spiral blade 43*a*. Thus, new supply of the toner and the carrier added through the developer supply port 22*g* can be quickly and sufficiently stirred to mix with a two-component developer in the first transport chamber 22*c*, and further, it is possible to effectively prevent the degradation of the speed of transporting the developer in the first transport chamber 22*c*. Furthermore, since the newly supplied toner and the developer existing in the first transport chamber 22*c* are sufficiently stirred to be mixed with each other before being transported to the second transport chamber 22*d*, it is possible to stabilize the toner concentration of the developer in the second transport chamber 22*d* which is supplied to the magnetic roller 21.

In a case where a height from the rotation shaft 43*b* to an edge of the second spiral blade 43*c* (radial-direction height h2, see FIG. 5) is smaller than one-fourth of a height from the rotation shaft 43*b* to an edge of the first spiral blade 43*a* (radial-direction height h1, see FIG. 5), it is impossible to generate sufficient convection of the developer in the pitch spaces of the first spiral blade 43*a*, and this degrades the stirring effect. On the other hand, in a case where h2 is larger than one-half of h1, a transportation force in the second direction generated by the second spiral blade 43*c* becomes so strong that it interferes with the transport movement in the first direction by the first spiral blade 43*a*.

Thus, the radial-direction height h2 of the second spiral blade 43*c* is desirably equal to or larger than one-fourth of the radial-direction height h1 of the first spiral blade 43*a* but equal to or smaller than one-half of the radial-direction height h1 of the first spiral blade 43*a*. This makes it possible both to generate convection of the developer in the pitch spaces of the spiral blade 43*a* and to effectively prevent the degradation of developer-transporting speed.

Figure 4:
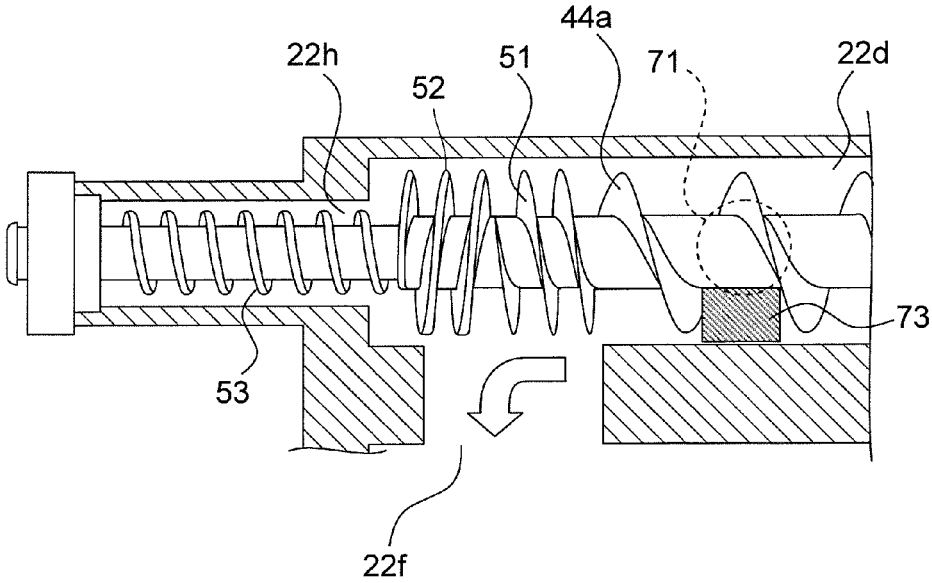
FIG. 4 is an enlarged view of a part around a developer discharge portion of the development device 2 embodying the present disclosure.

FIG. 4 is an enlarged view of a part around the developer discharge portion of the development device shown in FIG. 3. The second spiral 44 is provided with a low-speed transport portion 51 that is disposed to face the downstream-side communication portion 22*f* in the immediate upstream-side vicinity of the restriction portion 52 with respect to the developer transport direction (a direction indicated by the white arrow in FIG. 4).

The low-speed transport portion 51 is formed in a spiral form with a plurality of (herein, three) blades that point to the same direction as the spiral blade 44*a*. The spiral blades of the low-speed transport portion 51 are formed to have the same external diameter as the spiral blade 44*a* and are arranged at a pitch which is smaller than the pitch of the spiral blade 44*a*. The pitch at which the blades of the low-speed transport portion 51 are arranged is between one-sixth and one-third of the pitch of the spiral blade 44*a*, and these blades arranged in the spiral form face the opening width of the downstream-side communication portion 22*f* in the longitudinal direction. Incidentally, the spirally arranged blades of the low-speed transport portion 51 do not need to face the opening of the downstream-side communication portion 22*f* over the whole width of the opening; however, in this case, it is preferable that the blades on the restriction portion-52 side face the opening of the downstream-side communication portion 22*f*.

With this arrangement, when the rotation shaft 44*b* rotates, the spiral blade 44*a* transports the developer quickly in the second transport chamber 22*d*, but since the blades of the low-speed transport portion 51 are arranged at a pitch that is smaller than the pitch of the spiral blade 44*a*, the developer is transported at a lower speed in the portion of the second transport chamber 22*d* where the low-speed transport portion 51 is formed. Accordingly, the developer under transportation, which moves in a transport path like a wave following the outer circumference of the spiral blade 44*a*, moves fast with a comparatively large-pitched spiral blade like the spiral blade 44*a*, drastically changing its heap height. On the other hand, with a comparatively small-pitched spiral blade like the low-speed transport portion 51, the developer moves slowly, changing its heap height less drastically.

Thus, at the time of development without adding new supply of developer, the developer heap height changes less drastically in the vicinity of the low-speed transport portion 51 than in the other parts of the second transport chamber 22*d*, and the developer is transported comparatively slowly; thus, even if the developer collides with the restriction portion 52, the developer is prevented from jumping up over the outer circumference of the restriction portion 52. As a result, the developer does not move over the restriction portion 52, but the developer is transported into the first transport chamber 22*c* via the downstream-side communication portion 22*f*.

When the toner is consumed through the development, new supply of developer including the toner and the carrier is added from the developer supply port 22*g* to the first transport chamber 22*c*. The added developer is, in the same manner as in the development, transported by the first spiral blade 43*a* and the second spiral blade 43*b* of the first spiral 43 in the direction indicated by arrow P inside the first transport chamber 22*c*. Thereafter, the developer is transported by the spiral blade 44*a* of the second spiral 44 in the direction indicated by arrow Q inside the second transport chamber 22*d*, and is then transported to the lower-speed transport portion 51. On the other hand, when the restriction portion 52 rotates along with the rotation of the rotation shaft 44*b*, the restriction portion 52 gives the developer a transporting force in a direction opposite to the direction (indicated by arrow Q) in which the developer is transported by the spiral blade 44*a*.

The developer, which is transported at a reduced speed by the low-speed transport portion 51, collects in a large heap in the vicinity of the low-speed transport portion 51 which is located on an upstream side of the restriction portion 52, and a surplus portion of the developer (of an amount substantially equal to the amount of the developer added from the developer supply port 22*g*) flows over the restriction portion 52 to be discharged via the developer discharge port 22*h* to the outside of the development container 22.

Furthermore, in the second transport chamber 22*d*, a toner concentration detecting sensor 71 is placed beside the second spiral 44, on an upstream side of the low-speed transport portion 51 with respect to the developer transport direction (the direction indicated by the white arrow in FIG. 4). Incidentally, in FIG. 4, the second spiral 44 is located in front of the toner concentration detecting sensor 71, and thus the toner concentration detecting sensor 71 is indicated by the broken line.

Used as the toner concentration detecting sensor 71 is a magnetic permeability sensor which detects the magnetic permeability of the developer in the development container 22. When the magnetic permeability of the developer is detected by the toner concentration detecting sensor 71, a voltage value corresponding to the detection result is outputted to a control portion (not shown). Then, the control portion determines the toner concentration based on the output value from the toner concentration detecting sensor 71.

The output value from the sensor changes according to the toner concentration; as the toner concentration becomes higher, the ratio of the toner with respect to the magnetic carrier increases, and the increased ratio of the toner, which is not magnetically conductive, results in a low output value. On the other hand, as the toner concentration decreases, the ratio of the toner with respect to the magnetic carrier becomes lower, and thus the ratio of the carrier, which is magnetically conductive, is increased, and the increased ratio of the carrier results in a high output value.

Furthermore, the second spiral 44 is provided with a scraper 73 which is disposed at a portion of the second spiral 44 that faces the toner concentration detecting sensor 71. As the scraper 73, for example, a laminate member obtained by laminating a nonwoven fabric on a flexible film serving as a base is used. The scraper 73 is attached, in parallel with the rotation shaft 44*b*, to a scraper support portion (not shown) which is formed on the rotation shaft 44*b* of the second spiral 44. When the scraper 73 rotates along with the rotation shaft 44*b*, it scrapes and cleans a detection surface of the toner concentration detecting sensor 71, and the developer is promoted to stay where the sensor is disposed.

Figure 5:
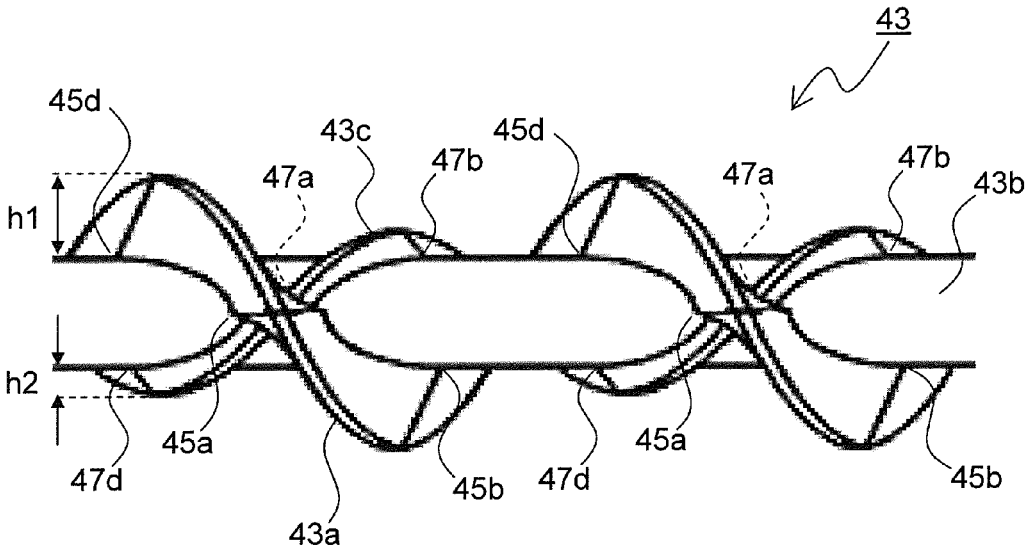
FIG. 5 is an enlarged side view showing a first spiral 43 which is the stir-transport member embodying the present disclosure.
Figure 6:
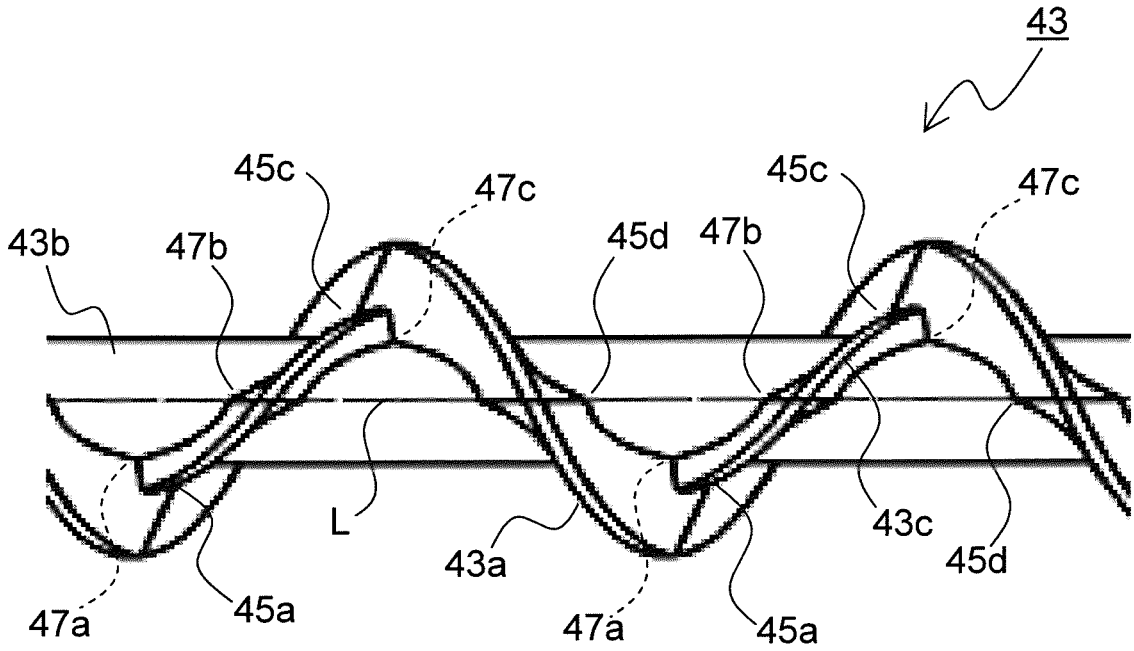
FIG. 6 is an enlarged side view showing a state of the first spiral 43 after it is rotated by 90° from the state shown in FIG. 5.

FIG. 5 is an enlarged view showing a part of the first spiral 43 which is a stir-transport member embodying the present disclosure, as seen from a direction perpendicular to the rotation shaft, and FIG. 6 is an enlarged view showing a state of the part after the first spiral 43 is rotated by 90° from the state shown in FIG. 5.

As shown in FIGS. 5 and 6, the first spiral blade 43*a* and the second spiral blade 43*c* included in the first spiral 43 each have a trapezoidal shape in the section taken along a direction that crosses a longitudinal direction thereof. Also, in the first spiral blade 43*a*, in a turn (pitch) around the rotation shaft 43*b*, portions (hereinafter, first swell portions) 45*a* to 45*d*, in each of which a part corresponding to the bottom (which is in contact with the rotation shaft 43*b*) of the trapezoidal shape is more swollen than in the other portions, are formed at four positions at intervals of 90°. Likewise, in the second spiral blade 43*c* as well, in a turn (pitch) thereof around the rotation shaft 43*b*, portions (hereinafter, second swell portions) 47*a* to 47*d*, in each of which a part corresponding to the bottom of the trapezoidal shape is more swollen than in the other portions, are formed at four positions at intervals of 90°. In this embodiment, the first spiral 43 is formed by using a mold that is separated into four parts in a (circumferential) direction that is perpendicular to the rotation shaft 43, the four first swell portions 45*a* to 45*d* and the four second swell portions 47*a* to 47*d* are formed corresponding to joints between the parts of the mold.

The first swell portion 45*a* of the first spiral blade 43*a* and the second swell portion 47*a* of the second spiral blade 43*c* are formed to cross each other, and the first swell portion 45*c* of the first spiral blade 43*a* and the second swell portion 47*c* of the second spiral blade 43*c* are formed to cross each other. That is, the first spiral blade 43*a* and the second spiral blade 43*c*, in a turn thereof around the rotation shaft 43*b*, cross each other at two positions apart from each other by 180°, namely, at the two first swell portions 45*a* and 45*c* and the two second swell portions 47*a* and 47*c*.

As a result, the locations of crossing parts at which the first spiral blade 43*a* and the second spiral blade 43*c* cross each other coincide with the locations of the first swell portions 45*a* and 45*c* of the first spiral blade 43*a*. Thus, the first swell portions 45*a* and 45*c* and the crossing parts of the first spiral blade 43*a* and the second spiral blade 43*c*, which have effects on the flow of the developer, are collectively located to thereby reduce their effects on the developer. As a result, the developer is prevented from being ruffled, and the amount of stress applied to the developer is reduced, and thus, insufficient charge of the toner due to degradation of the carrier can be prevented effectively.

Also, since the first swell portions 45*a* and 45*c* are formed in the first spiral blade 43*a*, and the second swell portions 47*a* and 47*c* are formed in the second spiral blade 43*c*, it is possible to enhance the strength of the first spiral blade 43*a* and the second spiral blade 43*c* and simultaneously secure a space for holding the developer. Furthermore, by forming the first swell portions 45*a* to 45*d* and the second swell portions 47*a* to 47*d* corresponding to the joints of the mold, it is possible to facilitate the operation of pulling the first spiral 43 out of the mold.

Also, since the radial-direction height h2 of the second spiral blade 43*c* is smaller than the radial-direction height h1 of the first spiral blade 43*a*, the second swell portions 47*a* and 47*c* of the second spiral blade 43*c*, which are located at the crossing parts, are included in the first swell portions 45*a* and 45*c*, respectively. This makes it possible to substantially eliminate the second swell portions 47*a* and 47*c*, and thus to further reduce the effects on the developer. That is, the first swell portions 45*a* and 45*c*, the second swell portions 47*a* and 47*c*, and the crossing parts of the first spiral blade 43*a* and the second spiral blade 43*c*, which have effects on the flow of the developer, are collectively disposed to thereby reduce the ruffling of the developer more effectively.

Furthermore, as shown in FIG. 6, the first swell portion 45*d* of the first spiral blade 43*a* which does not cross the second spiral blade 43*c* and the second swell portion 47*b* of the second spiral blade 43*a* which does not cross the first spiral blade 43*a* are located substantially on a same line L in a rotation-shaft-43*b* direction. The first swell portion 45*b* (see FIG. 5) which is located at a position that is displaced from the first swell portion 45*d* by 180° in phase and the second swell portion 47*d* (see FIG. 5) which is located at a position that is displaced from the second swell portion 47*b* by 180° in phase are also located substantially on a same line in the rotation-shaft-43*b* direction. With this arrangement, in comparison with an arrangement where the locations of the first swell portions 45*d* and 45*b* are different from the locations of the second swell portions 47*b* and 47*d*, respectively, in the rotation-shaft-43*b* direction, the developer moves more stably when the first spiral 43 rotates, and the developer is stirred in a more stable manner.

Also, if the radial-direction height h2 of the second spiral blade 43*c* is larger than one-half of the radial-direction height h1 of the first spiral blade 43*a*, the second swell portions 47*b* and 47*d* of the second spiral blade 43*c* which do not cross the first spiral blade 43*a* have larger effects on the developer, causing the developer to move in an unstable manner. For this reason as well, as has been mentioned above, it is preferable that the radial-direction height h2 of the second spiral blade 43*c* be equal to or smaller than one-half of the radial-direction height h1 of the first spiral blade 43*a*.

Incidentally, here, the first swell portion 45*a* of the first spiral blade 43*a* and the second swell portion 47*a* of the second spiral blade 43*c* are formed to cross each other and the first swell portion 45*c* of the first spiral blade 43*a* and the second swell portion 47*c* of the second spiral blade 43*c* are formed to cross each other, such that the first spiral blade 43*a* and the second spiral blade 43*c* cross each other at two positions in a turn thereof around the rotation shaft 43*b*, but this is not meant as a limitation, and preferably, at least one of the first swell portions 45*a* to 45*d* crosses at least one of the second swell portions 47*a* to 47*d* in a turn of the first and second spiral blades 43*a* and 43*c* around the rotation shaft 43*b*.

Also, at least one of the first swell portions 45*a* to 45*d* of the first spiral blade 43*a* may cross the second spiral blade 43*c* at a part thereof other than the second swell portions 47*a* to 47*d*. This arrangement has the advantage of collectively disposing at least one of the first swell portions 45*a* to 45*d* of the first spiral blade 43*a* and the crossing parts, but does not have the advantage of substantially eliminating at least one of the second swell portions 47*a* to 47*d* of the second spiral blade 43*c*. Thus, it is more preferable that, as in the above embodiments, at least one of the first swell portions 45*a* to 45*d* of the first spiral blade 43*a* cross at least one of the second swell portions 47*a* to 47*d* of the second spiral blade 43*c*.

It should be understood that the embodiments specifically described above are not meant to limit the present disclosure, and that many variations and modifications can be made within the spirit of the present disclosure. For example, although the foregoing descriptions of the embodiments have dealt with cases where the stir-transport member of the present disclosure is applied to the first spiral 43 which is disposed in the first transport chamber 22*c* of the development device 2, but depending on the specification of the developer, for more effective stirring in the second transport chamber 22*d*, a stir-transport member having an arrangement like the one applied to the first spiral 43 may be applied to the second spiral 44 which is disposed in the second transport chamber 22*d*.

In the above embodiments, the first swell portions 45*a* to 45*d* of the first spiral blade 43*a* and the second swell portions 47*a* to 47*d* of the second spiral blade 43*c* are formed at four positions in a turn of the first and second spiral blades 43*a* and 43*c* at intervals of 90°, but the number of the first and second swell portions may be determined according to the number of separations of the mold used for molding the first spiral 43. For example, if the mold is separated into three parts, they may be formed at three locations apart from each other by 120° in a turn of the first and second spiral blades 43*a* and 43*c* around the rotation shaft 43*b*, and if the mold is separated into two parts, they may be formed at two locations apart from each other by 180° in a turn of the first and second spiral blades 43*a* and 43*c* around the rotation shaft 43*b*.

Also, the stir-transport member of the present disclosure is applicable not only to the development device 2 that has, as shown in FIG. 3, the developer supply port 22*g* and the developer discharge port 22*h*, and that includes the magnetic roller 21 and the development roller 20, but also to various types of development devices that use a two-component developer including toner and a carrier. Hereinafter, specific descriptions will be given of the advantages of the present disclosure, with reference to examples.

EXAMPLES

Investigation was made into the charging property of the carrier, by using an image forming apparatus 1 shown in FIG. 1, which incorporates the development devices 2*a* to 2*d* shown in FIGS. 2 and 3, and with various structures of the first spiral 43 disposed in the first transport chamber 22*c*. Incidentally, examinations were conducted in a cyan image forming portion Pb which includes a photosensitive drum 11*b* and the development device 2*b*.

In the examinations, "present disclosure 1" includes an arrangement in which the diameter of the rotation shaft 43*b* of the first spiral 43 is 8 mm, the radial-direction height h1 and the blade pitch of the first spiral blade 43*a* is 4.5 mm and 30 mm, respectively, the radial-direction height h2 and the blade pitch of the second spiral blade 43*c* is 2.0 mm and 30 mm, respectively, and as shown in FIGS. 5 and 6, the first spiral blade 43*a* and the second spiral blade 43*c* cross each other at two positions corresponding to the first swell portions 45*a* and 45*c* and the second swell portions 47*a* and 47*c* in a turn thereof around the rotation shaft 43*b*. "Present disclosure 2" includes an arrangement that is similar to the arrangement of present disclosure 1 except that the radial-direction height h2 of the second spiral blade 43*c* is 3.0 mm. Further, "present disclosure 3" includes an arrangement that is similar to the arrangement of present disclosure 1 except that the first spiral blade 43*a* and the second spiral blade 43*c* cross each other at one position corresponding to the first swell portion 45*a* the second swell portion 47*a* in a turn thereof around the rotation shaft 43*b*. On the other hand, a comparative example is an arrangement in which none of the first swell portions 45*a* to 45*d* crosses the second spiral blade 43*c*.

The first spirals 43 according to present disclosures 1 to 3 and the comparative example were each attached to a development device 2*b*, and a two-component developer obtained by mixing 8 w/t parts of toner with 100 w/t parts of carrier was put in the development devices 2*b*. Thereafter, toner was removed from the developer after printing a test image of a coverage rate of 5% on 1000 sheets of paper in a row, and then new toner was added to 10*g* of the thus obtained carrier such that the toner concentration was 8%; then the toner charging amount was measured after the carrier and the toner were stirred together for 1 minute. Also, as a control, the toner charging amount was measured in the same manner by using 10*g* of the initial carrier which had not undergone development, and difference in toner charging amount was judged as significant if the toner discharging amount changed by ±2 μC/g or more. The results will be shown in Table 1.

TABLE 1

| | Toner charging amount (μC/g) | |
|---|---|---|
| | Initial carrier | Carrier after 1000-sheet printing |
| Present disclosure 1 | 25.6 | 24.7 |
| Present disclosure 2 | 25.6 | 21.2 |
| Present disclosure 3 | 25.6 | 23.4 |
| Comparative example | 25.6 | 19.6 |

As is clear from Table 1, with present disclosures 1 to 3, where at least one of the swell portions 45*a* to 45*d* of the first spiral blade 43*a* crosses the second spiral blade 43*c* in a turn thereof around the rotation shaft 43*b*, the toner charging amounts measured by using the carrier after printing on 1000 sheets of paper were all 21 μC/g or larger, specifically, in the rage of 21.2 to 24.7 μC/g, and the reduction of the charging property was minor compared with the case where the initial carrier was used. In particular, with present disclosure 1 in which the first spiral blade 43*a* and the second spiral blade 43*c* cross each other at two positions corresponding to the first swell portions 45*a* and 45*c* and the second swell portions 47*a* and 47*c* in a turn thereof around the rotation shaft 43*b*, and the radial-direction height h2 of the second spiral blade 43*c* is one-half of the radial-direction height h1 of the first spiral blade 43*a*, no significant difference of the toner charging amount was observed compared with the toner charging amount 25.6 μC/g of the case where the initial carrier was used, and the carrier was the least degraded.

In contrast, with the comparative example in which none of the first swell portions 45*a* to 45*d* crosses the second spiral blade 43*c*, the toner charging amount notably reduced to 19.6 μC/g, which is low, when the carrier after printing on 1000 sheets of paper was used, and thus charging performance was significantly degraded.

These results confirm that the arrangements of present disclosures 1 to 3 help reduce the degradation of the carrier in comparison with the arrangement of the comparative example. It is considered that this is because, with present disclosures 1 to 3 in which at least one of the first swell portions 45*a* to 45*d* crosses the second spiral blade 43*c*, a smaller amount of stress is applied to the developer while it is being stirred and transported, compared with the comparative example in which the first swell portions 45*a* to 45*d* and the crossing parts of the first and second spiral blades 43*a* and 43*c* exist apart from each other.

The present disclosure is applicable to a development device for use in image forming apparatuses that make use of an electro-photographic method such as copiers, printers, facsimile machines, and multifunction peripherals having these functions, and to an image forming apparatus provided with the development device; in particular, the present disclosure is applicable as a stir-transport member for use in a development device that uses a two-component developer which includes toner and a carrier. By using the stir-transport member of the present disclosure, it is possible to sufficiently mix carrier and toner together and to reduce the amount of stress applied to developer while it is stirred and transported, to thereby reduce the degradation of the carrier.

What is claimed is:

1. A stir-transport member, comprising:

a rotation shaft which is rotatably supported in a powder container;

a first spiral blade which is formed on an outer circumferential surface of the rotation shaft to transport powder in an axial direction when the rotation shaft rotates, the first spiral blade having a trapezoidal shape in section taken along a direction that crosses a longitudinal direction of the first spiral blade, the first spiral blade having a plurality of first swell portions, in each of which a part corresponding to a bottom of the trapezoidal shape is more swollen than in other portions of the first spiral blade, formed in a turn of the first spiral blade around the rotation shaft; and a second spiral blade which is formed on the outer circumferential surface of the rotation shaft so as to overlap a region where the first spiral blade is formed, the second spiral blade being opposite to the first spiral blade in phase, the second spiral blade being formed to have a smaller radial-direction height than the first spiral blade, the second spiral blade having a trapezoidal shape in section taken along a direction that crosses a longitudinal direction of the second spiral blade, the second spiral blade having a plurality of second swell portions, in each of which a part corresponding to the bottom of the trapezoidal shape is more swollen than in other portions of the second spiral blade, formed in a turn of the second spiral blade around the rotation shaft, wherein the first spiral blade crosses the second spiral blade at least at one of the first swell portions in a turn thereof around the rotation shaft, the second spiral blade crosses the first swell portions at the second swell portions, and the first spiral blade and the second spiral blade have formed therein the first swell portions and the second swell portions, respectively, at four positions at intervals of 90°, and the first spiral blade and the second spiral blade cross each other at two of the first swell portions that are apart from each other by 180° in a turn of the first spiral blade around the rotation shaft and two of the second swell portions that are apart from each other by 180° in a turn of the second spiral blade around the rotation shaft.

2. The stir-transport member of claim 1 wherein $$\frac{1}{4}\cdot h1 \leq h2 \leq 1/2\cdot h1$$

is satisfied, where h1 is a radial-direction height of the first spiral blade and h2 is a radial-direction height of the second spiral blade.

3. A development device, comprising:

the stir-transport member of claim 1;

a development container as the powder container for storing therein a two-component developer including toner and a carrier; and a developer carrying member which is disposed in the development container and carries the developer in the development container, wherein the stir-transport member stirs and transports the developer in the development container.

4. An image forming apparatus which incorporates the development device or claim 3.

5. A development device, comprising:

a first stir-transport member;

a second stir-transport member;

a development container as a powder container for storing therein a two-component developer including toner and a carrier; and a developer carrying member which is disposed in the development container and carries the developer in the development container, wherein, the first stir-transport member stirs and transports the developer in the development container; and wherein, the development container includes:

a first transport chamber and a second transport chamber which are disposed in parallel with each other;

a communication portion which communicates the first and second transport chambers to each other at both end sides of the first and second transport chambers in a longitudinal direction thereof; and a toner supply port through which toner is supplied to the first transport chamber;

wherein, the developer carrying member is disposed so as to carry the developer in the second transport chamber on a surface of the developer carrying member; and wherein, the first stir-transport member stirs and transports the developer in the first transport chamber in a rotation-axis direction; and the second stir-transport member stirs and transports the developer in the second transport chamber in a direction opposite to the direction in which the first stir-transport member stirs and transports the developer, and the first stir-transport member comprises:

a rotation shaft which is rotatably supported in the powder container;

a first spiral blade which is formed on an outer circumferential surface of the rotation shaft to transport powder in an axial direction when the rotation shaft rotates, the first spiral blade having a trapezoidal shape in section taken along a direction that crosses a longitudinal direction of the first spiral blade, the first spiral blade having a plurality of first swell portions, in each of which a part corresponding to a bottom of the trapezoidal shape is more swollen than in other portions of the first spiral blade, formed in a turn of the first spiral blade around the rotation shaft; and a second spiral blade which is formed on the outer circumferential surface of the rotation shaft so as to overlap a region where the first spiral blade is formed, the second spiral blade being opposite to the first spiral blade in phase, the second spiral blade being formed to have a smaller radial-direction height than the first spiral blade, the second spiral blade having a trapezoidal shape in section taken along a direction that crosses a longitudinal direction of the second spiral blade, the second spiral blade having a plurality of second swell portions, in each of which a part corresponding to the bottom of the trapezoidal shape is more swollen than in other portions of the second spiral blade, formed in a turn of the second spiral blade around the rotation shaft, wherein the first spiral blade crosses the second spiral blade at least at one of the first swell portions in a turn thereof around the rotation shaft, the second spiral blade crosses the first swell portions at the second swell portions, and the first spiral blade and the second spiral blade have formed therein the first swell portions and the second swell portions, respectively, at four positions at intervals of 90°, and the first spiral blade and the second spiral blade cross each other at two of the first swell portions that are apart from each other by 180° in a turn of the first spiral blade around the rotation shaft and two of the second swell portions that are apart from each other by 180° in a turn of the second spiral blade around the rotation shaft.

* * * * *